United States Patent [19]

Lutzen et al.

[11] Patent Number: 4,574,775

[45] Date of Patent: Mar. 11, 1986

[54] DIRECT CONTACT WATER HEATER

[75] Inventors: William C. Lutzen, Brookfield; Gerald A. Roszak, Brown Deer; Karen L. Gadomski, New Berlin, all of Wis.

[73] Assignee: Ludell Manufacturing Company, Milwaukee, Wis.

[21] Appl. No.: 714,688

[22] Filed: Mar. 21, 1985

[51] Int. Cl.[4] ..... F24H 1/10

[52] U.S. Cl. ..... 126/359; 122/28; 126/355

[58] Field of Search ..... 126/355, 359; 122/28, 122/5.5 A, 367 PF, 31 R

[56] References Cited

U.S. PATENT DOCUMENTS 3,190,283 6/1965 Miyahara ..... 122/28 X 3,826,240 7/1974 Miyahara ..... 126/355

*Primary Examiner*—Edward G. Favors

*Attorney, Agent, or Firm*—Fred Wiviott

[57] ABSTRACT

A direct contact water heater comprises a cylindrical column having a plurality of heat exchange bodies disposed in the upper portion thereof, a spraying device disposed above the heat exchange bodies for discharging water thereon, and a heating device disposed in the lower end of the column. The heating device comprises a burner oriented into the column and tangentially relative to the inner surface thereof. A shield extends across a portion of the column and above at least the initial path of the burner flame as it follows the contour of the column.

7 Claims, 2 Drawing Figures

DIRECT CONTACT WATER HEATER

BACKGROUND OF THE INVENTION

This invention relates to water heaters, and more particularly to direct contact water heaters.

Direct contact water heaters, such as that disclosed in U.S. Pat. No. 4,275,708 comprise a vertically oriented cylindrical column having a plurality of heat exchange bodies disposed adjacent its upper end. A spray nozzle is disposed above the heat exchange bodies for spraying the water to be heated downwardly onto the heat exchange bodies. A gas burner extends through an opening in the column and below the heat exchange bodies, for injecting a flame radially inwardly toward the axis of the column. The hot gasses from the flame pass upwardly through the heat exchange bodies in the column for discharge while the water to be heated flows downwardly over the heat exchange bodies and through the flame.

Some prior art direct contact water heaters have realized less than desired efficiencies. In particular, the contact between the water and the flame and the impingement of the flame on the relatively cool wall of the column on the side opposite the burner tends to result in incomplete combustion. This not only adversely effects efficiency, but also tends to produce aldehydes which are highly toxic.

In another type of prior art direct contact water heater, as disclosed in U.S. Pat. No. 3,648,682, the flame is confined to an open bottomed combustion chamber. While this prevents direct contact between the flame and the water being heated, the combustion chamber also tends to restrict flame length.

SUMMARY OF THE INVENTION

It is an object of the invention to provide a new and improved direct contact water heater.

A further object of the invention is to provide a direct contact water heater in which the initial path of the burner flame is shielded from the water flowing downwardly through the device.

Another object of the invention is to provide a direct contact water heater which permits a relatively long flame path which is shielded from water flow.

These and other objects and advantages of the present invention will become more apparent from the detailed description thereof taken with the accompanying drawings.

In general terms, the invention comprises a direct contact water heater which includes a column having a plurality of heat exchange bodies disposed in the upper end thereof, spraying means disposed above the heat exchange bodies for spraying water downwardly thereon, and heating means disposed in the lower end of the column. The heating means comprises a burner oriented into the column and tangentially relative to the inner surface thereof whereby the flame follows the inner surface of the column to define an arcuate flame flow path and a shield disposed above at least the initial portion of the flame flow path to prevent contact between the water flowing downwardly in the column and the initial portion of the flame.

DETAILED DESCRIPTION OF THE PREFERRED EMBODIMENT

Figure 1:
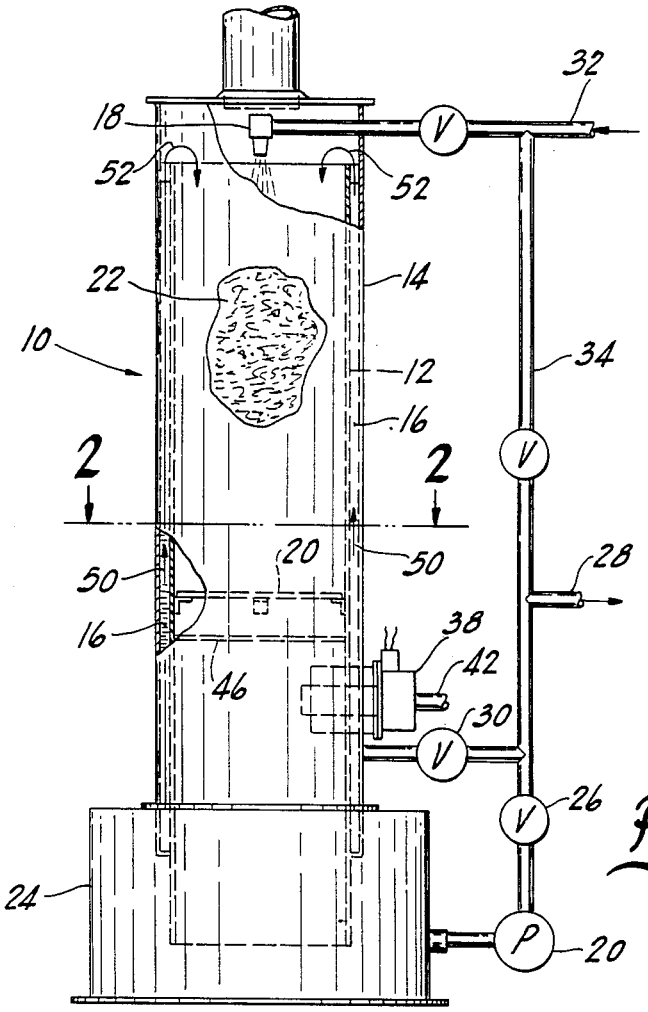
FIG. 1 is a side elevational view, partly in section, of a direct contact water heater, which incorporates a preferred embodiment of the invention.

The direct contact water heater 10 in accordance with the preferred embodiment of the invention is shown in FIG. 1 to include a vertically oriented, open ended tubular column 12 formed of any suitable metallic material. A tubular housing 14 surrounds the column 12 and is spaced therefrom to provide an annular flow path 15 therebetween. While the housing 14 and the column 12 are shown to be cylindrical, they may have any convenient shape. The upper end of the housing 14 extends above the upper end of the column 12 and is closed by a cover 16 an opening 17 connected to a flue 18.

A spray nozzle 19 is disposed in housing 14 above the upper end of column 12 and is connected to a source of water, as will be discussed more fully below. Extending horizontally across the column 16 and spaced above its lower end is a support screen 20 which supports a plurality of heat exchange bodies 22. The screen 20 is affixed to the inner surface of column 12 in any suitable manner. As those skilled in the art will appreciate, the heat exchange bodies 22 generally comprise a hollow tubular, spherical or egg shaped member having perforations or slots for absorbing heat from combustion products passing there through and for transferring the same to water flowing in the opposite direction. Since the heat exchange bodies 22 are conventional and well known in the art, they will not be discussed in detail for the sake of brevity.

In the preferred embodiment, the column 12 and the housing 14 are shown to be supported atop a water storage tank 24. The open lower end of the column 12 communicates with the tank while the lower end of the flow path 15 is closed by an annular barrier member 25 extending between the column 12 and housing 25. It is also contemplated that the column 12 and housing 14 will be free standing and connected to a separate water storage tank.

A suitable pump 26, has its inlet connected to the tank 24 and its outlet to pipes 27 and 28 for delivering heated water. In addition, a first recirculation pipe 30 is connected between pipe 27 and the flow path 15 between the column 12 and jacket 14. Cold water is delivered to nozzle 19 by pipe 32 and a second pipe 34 connects pipes 28 and 32.

Figure 2:
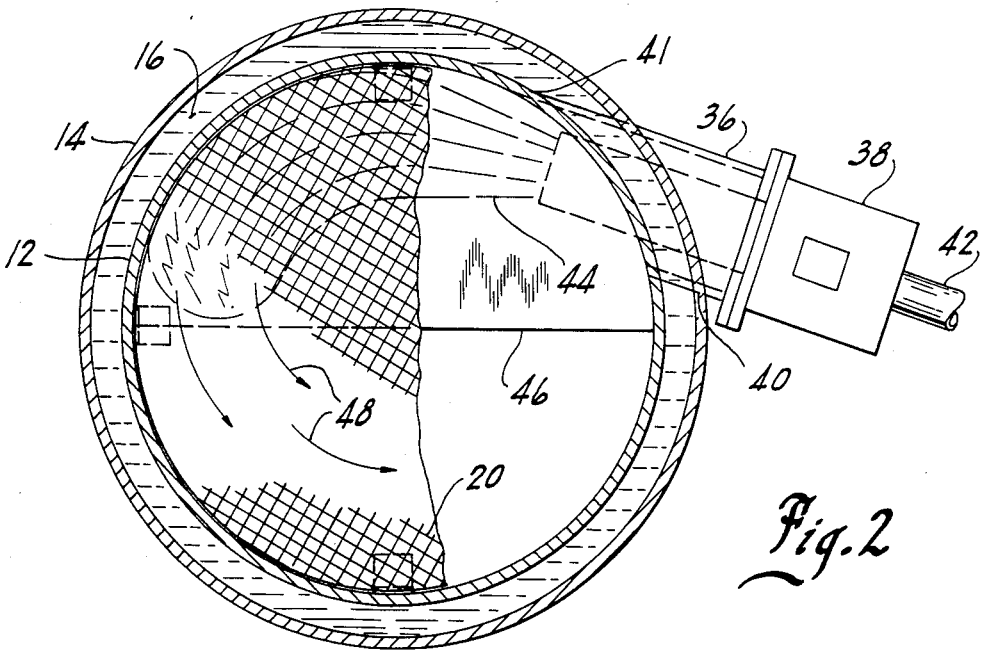
FIG. 2 is a view taken along lines 2—2 of FIG. 1.

A suitable fitting 36 is provided on jacket 14 for supporting a burner nozzle 38 in openings 40 and 41 formed in jacket 14 and column 12, respectively. The nozzle 38 is connected by conduit 42 to a suitable source of gaseous fuel and to a source of combustion air (not shown). In addition, the burner may be provided with an electric starting device 42. As seen in FIG. 2, the nozzle extends generally tangential to the cylindrical inner surface of the column 12 and below the screen 20. As a result, the burner flame 44 flows in an arcuate path along the inner surface of the column 12. Disposed between the burner 38 and the screen 20 is a semi-curricular shield 46. As seen in FIG. 2, the shield extends across one side of the column and substantially covers the nozzle 38 and at least the initial portion of the flame 44. While the shield is shown to be semi-circular it may have other shapes as well so long as it covers a substantive portion of the flame and still permits heated combustion products to flow upwardly through the heat exchange bodies 22 and allows water to flow in the opposite direction.

In operation of the water heater, cold water is initially discharged downwardly from nozzle 18 onto the heat exchange bodies 22 within the column 12. This water flows downwardly through the column and the screen 20 which supports its lower end. In the meantime, a suitable fuel gas and air mixture is provided to the burner 38, to produce the flame 44, which as indicated above, follows the arcuate internal surface of the column 12. As the heated gasses continue to flow, they pass below the edge of the barrier 46, as indicated by arrows 48, and then upwardly through the heat exchange bodies 22 in countercurrent to the water flowing downwardly. The heated gasses release heat to the bodies 22 which in turn transfer the same to the downwardly flowing water. This heated water collects in tank 24 from which it is delivered by pump 26 to outlet pipe 28.

The barrier 46 acts to prevent direct contact between the water and the flame 44. As a result, a relatively longer flame can be achieved, and more complete combustion realized. In addition, because the flame follows the arcuate contour of the column 12, it does not impinge directly upon the relatively cooler surface at the opposite side of the column 12.

The first recirculation pipe 30 delivers a portion of the heated water within the tank 24 to the gap between the column 12 and the jacket 14. This water flows upwardly in this gap 15, and then inwardly to the center of column 12 as illustrated by arrows 50 and 52. This acts to cool the jacket 14. Cold feed water may also be delivered to gap 15 through the feed pipe 34.

Where only a single embodiment of the invention has been illustrated and described, it is not intended to be limited thereby but only by the scope of the appended claims.

We claim:

1. A direct contact water heater having a vertically oriented open-ended column, a plurality of heat exchange bodies disposed in the upper end of said column, a spraying device disposed above said heat exchange bodies for discharging water to be heated downwardly thereon, said column being curvilinear in horizontal cross section, a burner extending into said column below said heat exchange bodies and generally tangential to the curvilinear inner surface thereof, shield means disposed in said column and between said burner and said bodies, said shield means covering a portion of the burner flame generated by said nozzle, there being a substantial open area between said column and said shield means so that heated combustion products and water are permitted to flow around said shield means.

2. The direct contact water heater set forth in claim 1 wherein said shield means comprises a relatively flat baffle having a first curviliniar edge complimentary to and engaging the inner surface of said column and in the area thereof above said burner flame, said baffle also including a second edge portion spaced from the column at its opposite side to permit combustion products to flow horizontially and around the second edge of said baffle and upwardly through said column and for water to flow around said baffle and downwardly therefrom.

3. The direct contact water heater set forth in claim 2, wherein said column comprises an open-ended tubular member, storage tank means supporting said column, the open lower end of said column communicating with said storage tank means.

4. The direct contact water heater set forth in claim 3, and including a housing surrounding said column and spaced therefrom so as to define a gap there between, the lower end of said gap being closed, and means for recirculating heated water from said tank to said gap whereby said water flows upwardly in said gap for cooling said column and said housing.

5. The water heater set forth in claim 4, wherein screen means extends horizontally across said column and above said barrier, said heat exchange bodies being supported on said screen means.

6. The water heater set forth in claim 5 wherein said column is generally circular in cross-section and said baffle is generally semi-circular in plan view.

7. The water heater set forth in claim 1 wherein said column is generally circular in cross-section, said burner projecting a flame generally tangentially relative to said column so that the flame follows the circular inner surface of the column.

* * * * *